United States Patent [19]

Funck et al.

[11] 4,294,103

[45] Oct. 13, 1981

[54] OVERLOAD SAFETY DEVICE IN HYDRAULIC FORMING PRESSES, IN PARTICULAR SHEET METAL FORM DRAWING PRESSES

[75] Inventors: Willi Funck, Meerbusch; Roland Verheyen, Krefeld; Heinz Schedler, Heidesheim, all of Fed. Rep. of Germany

[73] Assignee: Schloemann-Siemag Aktiengesellschaft, Dusseldorf, Fed. Rep. of Germany

[21] Appl. No.: 145,495

[22] Filed: May 1, 1980

[30] Foreign Application Priority Data

May 11, 1979 [DE] Fed. Rep. of Germany ..... 2919012

[51] Int. Cl.[3] ..... B21J 9/20

[52] U.S. Cl. ..... 72/453.14; 100/46; 100/258 A

[58] Field of Search ..... 72/453.14, 453.01, 453.18, 72/444, 456, 455, 446; 100/46, 258 A

[56] References Cited

U.S. PATENT DOCUMENTS

| | | | |
|---|---|---|---|
| 2,343,167 | 2/1944 | Bench | 100/46 |
| 2,377,007 | 5/1945 | Hess | 100/46 |
| 2,565,639 | 8/1951 | Waldie | 100/46 |
| 2,594,204 | 4/1952 | Nowak | 72/453.18 |
| 3,195,449 | 7/1965 | Jureit | 100/46 |
| 4,157,066 | 6/1979 | Pretty | 100/46 |

*Primary Examiner*—Gene P. Crosby

*Attorney, Agent, or Firm*—Holman & Stern

[57] ABSTRACT

An overload safety device for a hydraulic press of the type in which a parallel linkage is mounted on the moveable beam to ensure normal accurate alignment if constituted by an operating rod mounted preferably on the transverse connecting rod of the parallel linkage in order to operate limit switches in accordance with longitudinal dimension changes due to compressive or tensile forces in this connecting rod arising from asymmetrical load. The operating rod can be arcuate and mounted at each end on the connecting rod or can be straight and mounted at one end only. Flexing of the arcuate rod or relative movement of the free end of the straight rod can be magnified by a mechanical linkage with an arm operating the limit switches.

9 Claims, 14 Drawing Figures

OVERLOAD SAFETY DEVICE IN HYDRAULIC FORMING PRESSES, IN PARTICULAR SHEET METAL FORM DRAWING PRESSES

BRIEF SUMMARY OF THE INVENTION

The invention relates to an overload safety device on hydraulic forming presses, in particular sheet metal form drawing presses, for tool and machine protection wherein the press frame consists of (a) a table beam with a press table attached thereto, an opposing beam spaced therefrom, and end supports spacing said beams each provided with tension members and (b) a travelling beam guided at said opposing beam provided with at least one pressure cylinder to exert at said table a pressing force opposed by said tension members. Such a press is guided by means of a parallel linkage consisting of interconnected angle levers and rods, as described in more detail below.

A parallel linkage of this type for the accurate guidance of the travelling beam or ram on a hydraulic drawing press is known, for example, from the book "Hydraulische Pressen und Druckflüssigkeitsanlagen" by Ernst Müller, Volume 2, Springer-Verlag, Berlin/Göttingen/Heidelberg, 1955, on page 158, FIG. 133.

As the work pieces to be formed are not generally produced symmetrically, a sheet metal form drawing press, for example, becomes loaded eccentrically during the forming process. These requirements are generally taken into consideration in the design of the press itself, since the ram guide is suitably stable in design. However, very strong eccentric loads may still arise, which, under some circumstances, can destroy the machine and tool during the forming process. For this reason, these types of presses require overload safety devices which protect and switch off the machine before excessive eccentric loading occurs.

The object of the present invention is to provide an overload safety device of this type on hydraulic forming presses which is simple in design and in outlay, reliable in operation and requires little maintenance and which also gives information about the position of the eccentric force.

According to the invention, the press as described above provided with at least one parallel linkage constituted by (a) a connecting rod pivoted at one end to one end of the travelling beam, (b) an angle lever pivoted at the end of an upper arm thereof to the other end of said connecting rod (c) a like connecting rod pivoted at one end to the other end of the travelling beam, (d) a like angle lever, with its included angle facing the same direction as the first, and similarly pivoted at the end of an upper arm thereof to the other end of the like connecting rod, and (e) a transverse connecting rod pivoted at both ends one to each lower arm of said angle levers, is further provided with a safety device comprising an operating rod fixed to lie along at least one of said connecting rods in such a way as to move with the small changes in longitudinal dimension of said connecting rod due to tensile or compressive strain arising from unsymmetrical press loading, and switch means operable by said movements of the rod to actuate an overload indication.

The tensile and compressive strains occurring in the connecting rods due to eccentric loading are converted in a simple manner into relative movements between the connecting rods and profiled switch-operating rods since the connecting rods stretch and compress elastically in the longitudinal direction whereas the operating rods are not used for transferring the forces occurring in the connecting rods and thus maintain the original length of their longitudinal axis.

Due to the relative movements, it is possible to have the machine switched off, when excessive eccentric forces occur in the machine, by means of the limit switches which are arranged e.g. on the connecting rods for operation by the operating rods.

In one form of the invention, said press is vertically operable;

said operating rod is arcuate and fixed at each end to the transverse connecting rod, whereby changes of dimension in said transverse connecting rod are converted to a relatively greater change in spacing of the crown region of said arcuate operating rod from the transverse connecting rod; and said switch means is in the form of limit switches arranged to be operable at least one in either direction of crown movement.

When the connecting rods are subjected to a load originating from an irregular forming process, the elastic deformations from tensile or compressive stresses are transferred to the curved operating profile rod with its two ends fixed to the connecting rod. The curved profile rod does not undergo a change in length along its longitudinal axis, but the spacing of the crown of the curvature relative to the surface of the connecting rod increases when there is compressive strain in the connecting rod but decreases with tensile strain. Relative motion perpendicularly to the connecting rod axis therefore takes place here. This elastic change in length differs according to the loading of the connecting rods and thus the differing change in height of the curved profile rod perpendicularly to the axis of the connecting rod is advantageously used for the respective actuation of limit switches.

In another possible embodiment of the invention, said press is vertically operable;

said operating rod fixed at one end only to the transverse connecting rod whereby there is a change in position of the other end relative to a point on the surface of the transverse connecting rod upon changes in dimension of this connection rod; and said switch means is in the form of limit switches arranged to be operable at least one in either direction of said relative movement.

One end of the operating rod is therfore rigidly connected to the connecting rod while the other free end is freely movable parallel to the connecting rod and the elastic change in length resulting from the loading of the connecting rod and relative to the free end of the straight profile rod becomes effective. In this case, this free end co-operates with limit switches arranged on the connecting rod and responding in the respectively opposite direction in order to actuate the limit switches. This allows the press to be brought to a standstill in a simple manner in the event of a load which is too irregular.

In order to achieve only a warning signal initially, followed by stoppage of the press, there may be provided on the connecting rods two adjacent limit switches (each with different spacings relative to the profile rods) in each direction of the movement of the profile rod (i.e. four such switches in all) to respond to progressive movement relative to the horizontal connecting rods.

In an advantageous development of the invention a mechanical linkage between the operating rod and the limit switches may be provided to magnify the movement of the operating rod.

With an arcuate operating rod, it can be arranged so that the linkage comprises a lever arm pivoted at one end thereof on the transverse connecting rod and being in operative connection with said limit switches at the other end thereof; and wherein an intermediate region of said lever arm is connected for movement with the crown of the arcuate operating rod so that the said movement is magnified at the limit switches.

In this way, movements relative to the operating rods fixed on the connecting rods are initially produced from the smallest changes in length due to elastic expansion or compression in the connecting rods. This deflection difference is increased by means of a lever and utilised for the reliable actuation of the limit switches.

Using the above-mentioned overload safety device, it is possible to achieve in a simple manner and without high production costs in the event of strong eccentric forces during the forming process first of all a warning signal at, for example, 80% of the permissible stress by means of one limit switch and then to switch off the press when the permissible stress is achieved or exceeded by means of another limit switch.

The elastic deformations of press table and travelling beam, or ram, about their horizontal longitudinal axes due to eccentric loads in addition to the press axis and in addition to the respective horizontal longitudinal axis cause one of the horizontal (i.e. transverse) connecting rods to be loaded more than the other. The horizontal connecting rods generally lie beneath the press table and symmetrically and parallel to the longitudinal axis thereof. The profiled operating rods can be fixed on the outside or inside of the connecting rods with respect to the press table. It is preferable to fix them on the outside to give easier access. This arrangement and the elastic deformations described above allow locally occurring eccentric loads to be allocated to the corresponding limit switches and the associated signal to be indicated at the control cabinet. This warning can be given optically and/or acoustically.

It is therefore possible to determine by means of the limit switches responding at any time at which point on the travelling beam or the press table there occurs the strongest eccentric load which can also be made visible in a similar manner at the control cabinet.

BRIEF DESCRIPTION OF THE SEVERAL VIEWS OF THE DRAWINGS

The invention is described in more detail with reference to the accompanying drawings, in which.

DETAILED DESCRIPTION

Figure 1:
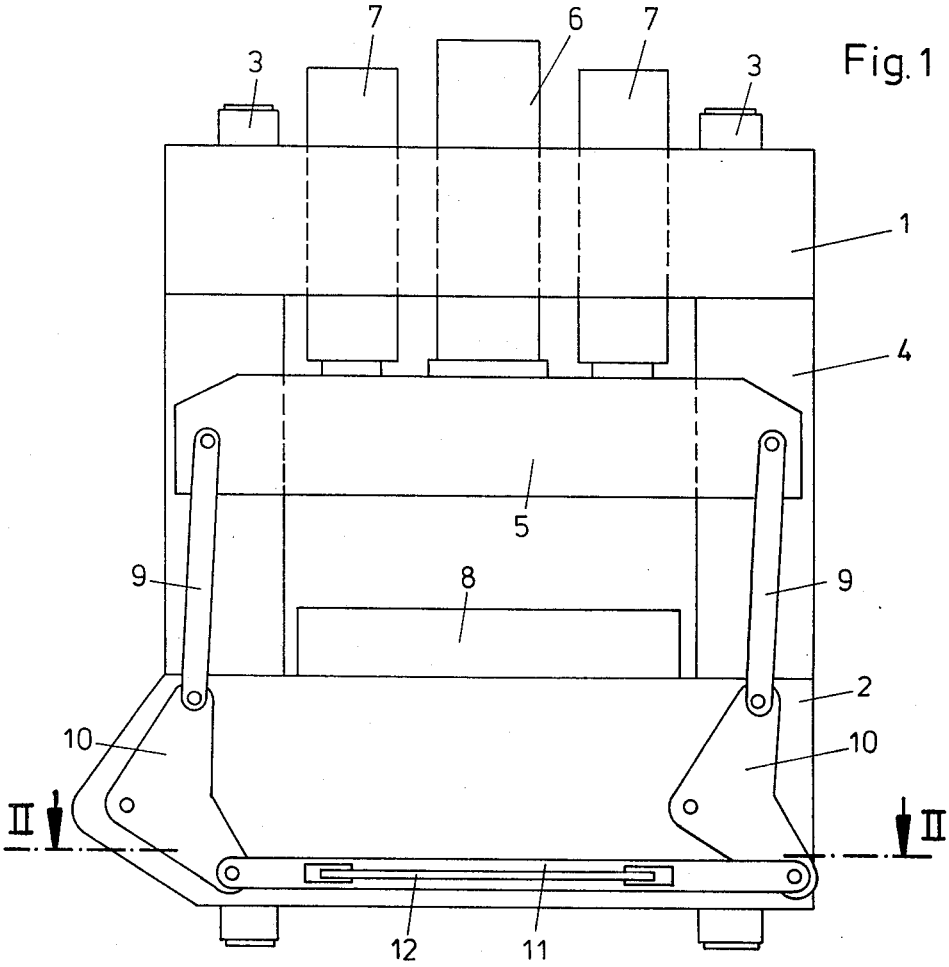
FIG. 1 shows a view of a metal form drawing press.

A metal form drawing press consists of an opposing beam 1 and a table beam 2 which are connected by means of tension members 3 to support pillars 4 arranged as pressure members between the opposing beam 1 and table beam 2. In this case, a travelling beam or ram 5 is guided, for example, by a central shank 6. The pressing force is exerted on the ram 5 by means of hydraulic cyllinders 7 arranged in the opposing beam 1. Returns (not shown) lift the ram 5 again upon completion of the pressing or forming process.

Figure 1A:
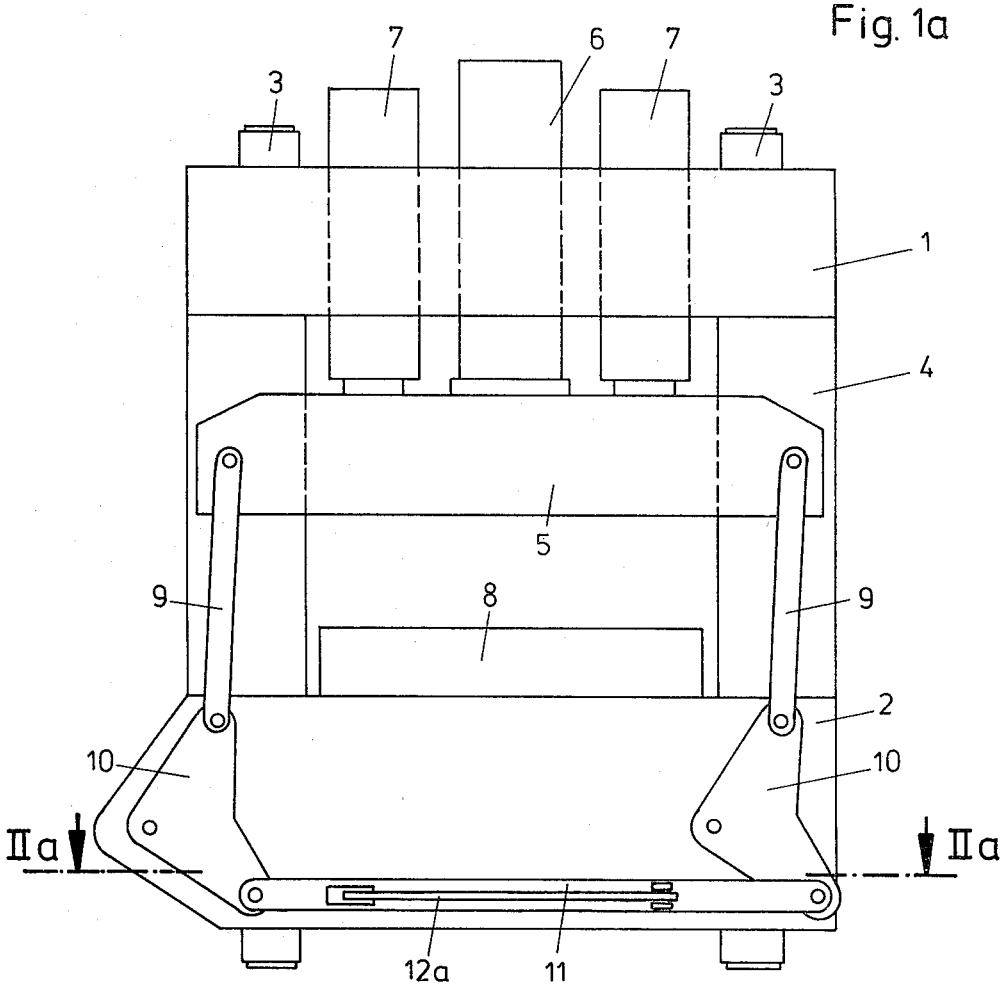
FIG. 1*a* is a view of a metal form drawing press as in FIG. 1.

A press table 8 is provided on the table beam 2. The ram 5 is also guided to the press table 8 by means of a parallel linkage. The parallel linkage consists of vertical connecting rods 9 which are pivoted to the sides of the ram 5 and which are also pivoted, at their lower ends, to the upper arms of angle levers 10, with horizontal pivot axes, each arranged on the stationary table beam 2 and having similarly directed angle openings, i.e. pointing in the same direction. Each lower arm of each angle lever is pivoted along the sides of the press table 8 to a horizontal connecting rod 11 (FIG. 1 and FIG. 1*a*). There are of course two such linkages, only one being visible in the elevation shown.

Figure 2:
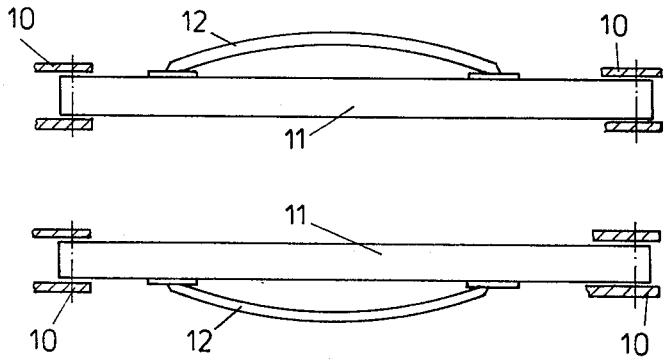
FIG. 2 is a section along lines II—II in FIG. 1, showing the horizontal connecting rods of the parallel linkage of the press with profiled operating rods fixed on them and curved in the longitudinal axis.
Figure 4:
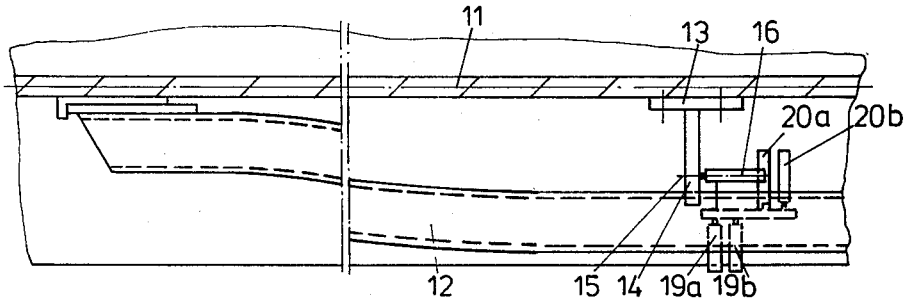
FIG. 4 is a section along lines IV—IV in FIG. 3 showing the connecting rod, curved profiled rod and limit switch.

Profiled rods 12 which are curved outwards in a horizontal plane are fixed by their ends to the two horizontal connecting rods 11. These rods are designed, for example, as I-beams (FIG. 2). The profiled rods 12, in the embodiment shown, are hollow and rectangular in cross-section. On the stem, i.e. the perpendicular cross piece of each I-beam horizontal connecting rod 11 there is fixed, on the outer surface between the fixing points of the profiled rods 12 a base plate 13 to which another plate 14 is welded on edge perpendicularly, as shown in FIG. 4. On plate 14 there is fixed, at a distance from and parallel to the stem of connecting rod 11 a stay bolt 15 to which is pivoted a one-armed lever arm 16. The lever arm 16 is connected by means of a surrounding U-shaped frame 17 and adjustable screws 18 to the profiled rod 12. Thus any deflection of the crown of the curved profiled rod 12 transversely to its axis is transferred to the lever arm 16 (FIG. 5).

Figure 5:
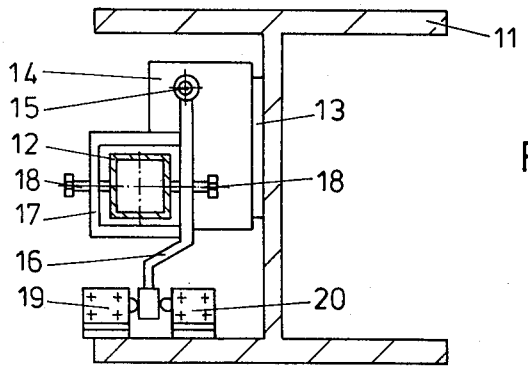
FIG. 5 is a cross-section along lines V—V in FIG. 3 showing the connecting rod with curved profiled rods and lever transmission between profiled rod and limit switches.

Limit switches 19 and 20 are arranged on the lower flange of the I-beam connecting rod 11 (FIG. 5). The free end of the lever arm 16 lies between the limit switches 19 and 20. The distance between the switch cams or switch tappets of the limit switches 19 and 20 and the lever arm 16 is adjustable so that the respective limit switches respond to a specific deflection of the lever arm 16 to one side or the other. The lever arm 16 thus permits transmission of the relatively small deflection of the crown of the curved profiled rods 12, due to elastic expansion or compression in the connecting rod 11, and ensures reliable determination of the eccentric forces occurring during the forming process in the press.

Figure 3:
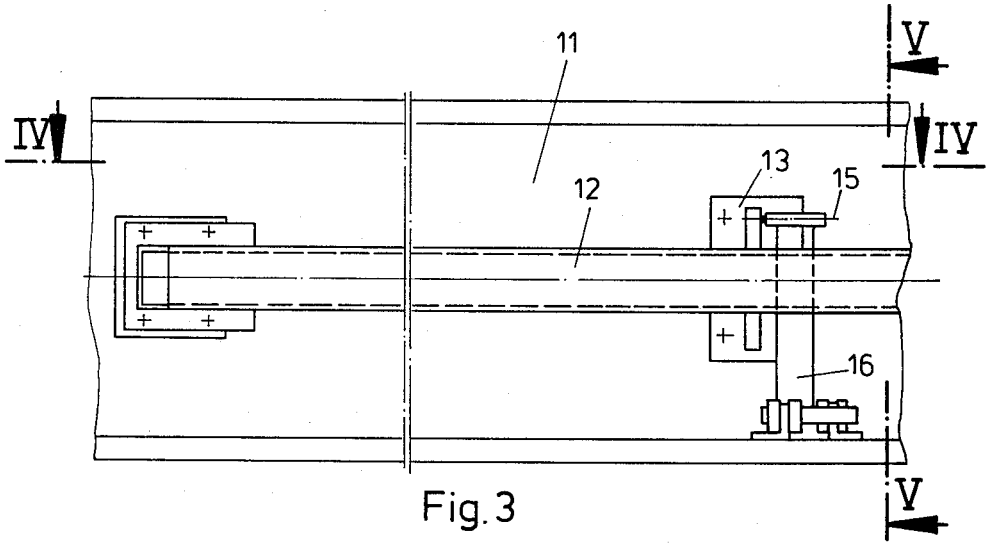
FIG. 3 shows a detail of the connecting rod with a curved operating rod, on an enlarged scale.

It is beneficial (see FIG. 3) to arrange two limit switches 19*a*, 19*b* and 20*a*, 20*b* alternately on the right and on the left of the lever arm end and in opposed pairs. The limit switches 19*a* and 20*a*, for example, can thus be adjusted with less play and the limit switches 19*b* and 20*b* with more play relative to the lever arm. The limit switches 19*a* and 20*a* thus can respond during deflection of the lower arm and the limit switches 19*b* and 20*b* can respond during further deflection. The limit switches 19*a* and 20*a* can be connected to an acoustic or optical signal as a warning signal or warning lamp and the limit switches 19*b* and 20*b* can be connected both to valves for switching off the hydraulic cylinders 7 and to other optical signals (FIG. 3).

Figure 2A:
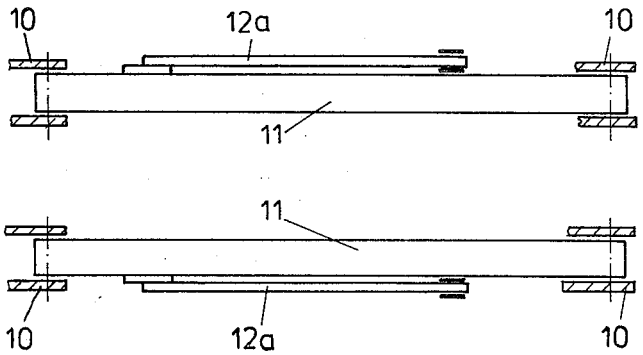
FIG. 2*a* is a section along line II*a*—II*a* in FIG. 1*a* showing the horizontal connecting rods of the parallel linkage of the press with straight profiled operating rods fixed on them by one end and slidably guided by the other end.
Figure 3A:
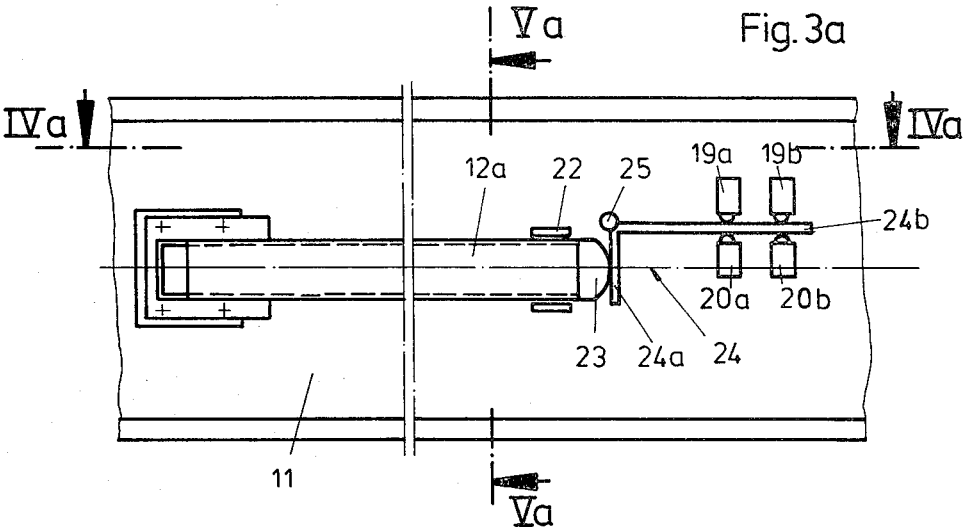
FIG. 3*a* shows on enlarged scale a detail of the connecting rod with a straight profiled rod and lever transmission between profile rod and limit switches.
Figure 4A:
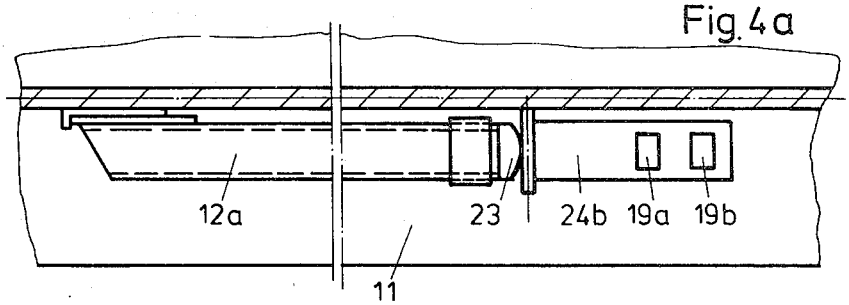
FIG. 4*a* is a plan view along lines IV*a*—IV*a* in FIG. 3*a* showing the connecting rod, straight profiled rod and limit switch.
Figure 5A:
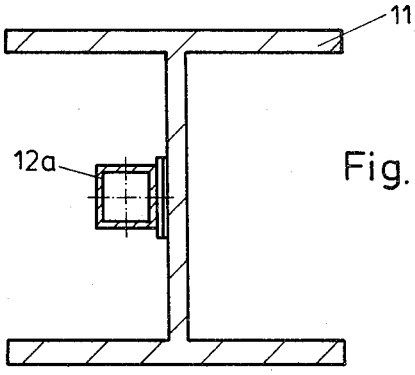
FIG. 5*a* is a cross-section along lines V*a*—V*a* in FIG. 3*a* showing the connecting rod with straight profiled rod.

In another example of the invention, a metal form drawing press which is similar to the one in FIG. 1 is also shown in FIG. 1*a* but with the difference that there are provided on the horizontal connecting rods 11 straight profiled rods 12*a* each of which is connected positively only at one end to the connecting rod 11, the other end being slidably guided axially in a guide 22 on the connecting rod 11 (FIGS. 2*a* and 3*a*).

A tensile or compressive stress on the connecting rod 11 gives a relative axial movement between connecting rod 11 and the free end of the straight profiled rod 12*a*. This is then used for the switching process by limit switches 19 and 20 arranged on the connecting rods 11.

For better determination of the slight relative movements, a lever transmission may also be provided in this example, between the face 23 of the free end of the straight profiled rod 12*a* and limit switches 19*a*, 19*b* and 20*a*, 20*b* which are arranged on the connecting rod 11 (FIG. 3*a*).

An angle lever 24 with a fulcrum 25 on the connecting rod 11 lies with its shorter lever arm 24*a* on the face 23 of the straight profile rod 12*a*, and its longer lever arm 24*b* against the switching cams or tappets of the limit switches 19*a*, 19*b* and 20*a*, 20*b*.

Figure 6A:
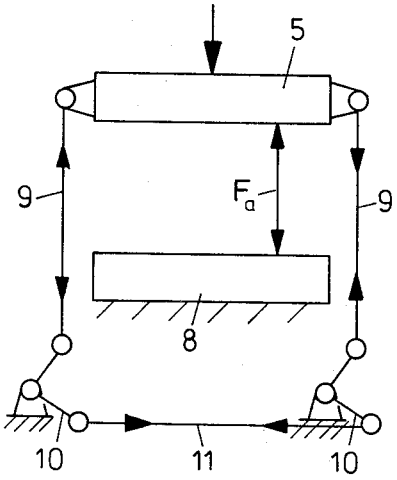
FIG. 6*a* is a schematic view of the parallel linkage, with compressive or tensile forces indicated in it when an eccentric load occurs on the right of the vertical press axis.

FIG. 6*a* shows a schematic view of the parallel linkage between travelling beam or ram 5 and table beam 2, with vertical connecting rods 9 which are pivoted on the travelling beam 5 and on the upper arms of angle levers 10, horizontal connecting rods 11 being pivoted to connect the lower arms of the angle levers 10 in pairs.

Eccentric loading Fa of the press between ram 5 and press table 8, on the right of the press axis, produces tensile strain in the right-hand vertical connecting rod 9, compressive strain in the left-hand vertical connecting rod 9 and a tensile strain in the horizontal connecting rod 11. The strain directions are indicated by corresponding arrows in the rods in FIG. 6*a*. A curved profiled rod 12, will thus become stretched, i.e. its crown will deform elastically toward the surface of the connecting rod 11. A straight profiled rod 12*a* will move at its free end relative to an imaginary fixed point on the surface of connecting rod 11. Thus, when using the angle lever 24 according to FIG. 3*a*, the longer arm 24*b* of this lever will actuate the switching cams of the limit switches 20*a* and 20*b*.

Figure 6B:
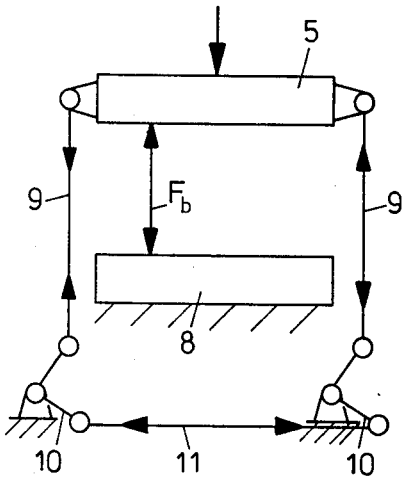
FIG. 6*b* is a view as in 6*a* but with eccentric loading occurring on the left of the vertical press axis.

As in FIG. 6*a*, FIG. 6*b* shows an eccentric load Fb, but on the left of the press axis. A tensile strain now occurs in the left-hand vertical connecting rod 9, a compressive strain in the right-hand vertical connecting rod 9 and a compressive strain in the horizontal connecting rod 11. The curved profiled rod 12 which is rigidly connected to the horizontal connecting rod 11 now also experiences compression, i.e. its crown will deform elastically outwards away from the surface of the horizontal connecting rod 11 and actuate the limit switches 19*a* and 19*b* by means of lever arm 16. When using a straight profiled rod 12*a*, the reverse of the relative movement of FIG. 6*a* takes place.

Figure 7:
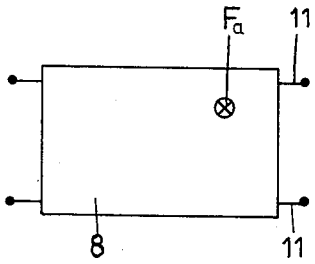
FIG. 7 is a plan view of the press table with an eccentric load occurring in the rear right-hand quarter.

FIG. 7 shows schematically an eccentric load Fa in the right-hand rear field of the press table 8, seen from above. The horizontal connecting rod 11 (not visible in FIG. 1 but effectively responsive to this field) will thus be stressed more than the front horizontal connecting rod 11 (visible in FIG. 1) as shown in FIG. 7. The rear horizontal connecting rod 11 (not shown in FIG. 1) receives a tensile strain as described with reference to FIG. 6*a*. The relevant and corresponding limit switches will thus respond to a corresponding load in the manner described above.

Figure 8:
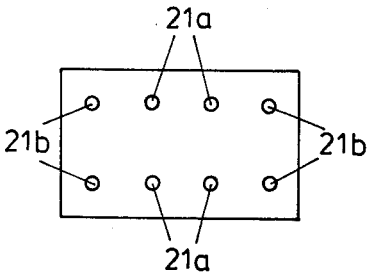
FIG. 8 shows an arrangement of warning lamps at the control cabinet of the press machine similar to the distribution of the press table surface.

Eight lamps 21 which can be provided on the control cabinet are connected, in a similar manner to the press table surface 8, to the eight limit switches 19*a*, 19*b* and 20*a*, 20*b*, each four being connected to a relevant one of the front and back horizontal connecting rods 11 and their profiled rods 12 or 12*a* (FIG. 8). The four inner lamps 21*a* of a green colour, are connected to the various limit switches 19*a* and 20*a* and the four outer lamps 21*b* for special warnings, of a red colour, are connected to the various limit switches 19*b* and 20*b*, the press also being switched off simultaneously when the red bulbs light.

We claim:

1. A safety device against overload in a hydraulic forming press in particular for shaping sheet metal, said press comprising:

(A) A table beam with a press table attached thereto, an opposing beam spaced therefrom, and end supports spacing said beams each provided with tension members;

(B) A travelling beam guided at said opposing beam provided with at least one pressure cylinder to exert at said table a pressing force opposed by said tension members, (C) at least one parallel linkage comprising (a) a connecting rod pivoted at one end to one end of the travelling beam (b) an angle lever pivoted at the end of an upper arm thereof to the other end of said connecting rod (c) a like connecting rod pivoted at one end to the other end of the travelling beam (d) a like angle lever, with its included angle facing the same direction as the first, and similarly pivoted at the end of an upper arm thereof to the other end of the like connecting rod (e) a transverse connecting rod pivoted at both ends one to each lower arm of said angle levers:

said safety device comprising an operating rod fixed to lie along at least one of said connecting rods in such a way as to move with the small changes in longitudinal dimension of said one connecting rod due to tensile or compressive strain arising from unsymmetrical press loading, and switch means operable by said movements of said one rod to actuate an overload indication.

2. A safety device as claimed in claim 1 wherein:

said press is vertically operable;

said operating rod is arcuate and fixed at each end to the transverse connecting rod, whereby changes in dimension of said transverse connecting rod are converted to a relatively greater change in spacing of the crown region of said arcuate operating rod from the transverse connecting rod; and said switch means is in the form of limit switches arranged to be operable at least one in either direction of crown movement.

3. A safety device as claimed in claim 2 in which a mechanical linkage magnifying the movement of the arcuate operating rod is provided between said operating rod and said limit switches.

4. A safety device as claimed in claim 3 wherein the mechanical linkage comprises a lever arm pivoted at one end thereof on the transverse connecting rod and being in operative connection with said limit switches at the other end thereof; and wherein an intermediate region of said lever arm is connected for movement with the crown of the arcuate operating rod so that the said movement is magnified at the limit switches.

5. A safety device as claimed in claim 1 wherein:

said press is vertically operable;

said operating rod is fixed at one end only to the transverse connecting rod whereby there is a change in position of the other end relative to a point on the surface of the transverse connecting rod upon changes in dimension of this connecting rod; and said switch means is in the form of limit switches arranged to be operable at least one in either direction of said relative movement.

6. A safety device as claimed in claim 5 in which a mechanical linkage magnifying the said relative movement of the operating rod is provided between said operating rod and said limit switches.

7. A safety device as claimed in claim 6 wherein the mechanical linkage comprises an angle lever pivoted at its angle on the transverse connecting rod and having a shorter arm and a longer arm; and wherein said shorter arm contacts the free end of the said operating rod and the longer arm is in operative connection with said limit switches so that said relative movement of the operating rod is magnified at the limit switches.

8. A safety device as claimed in any one of claims 1 to 7 said switch means possessing two limit switches with one operable in either direction of operating rod movement.

9. A safety device as claimed in any one of claims 1 to 7 said switch means possessing four limit switches with two operable in either direction of operating rod movement as a first and second switch to indicate a lower and a higher degree of overload respectively.

* * * * *